United States Patent [19]

Evrard

[11] Patent Number: 4,644,161

[45] Date of Patent: Feb. 17, 1987

[54] MASS SPECTROGRAPH

[75] Inventor: Robert Evrard, Nesles la Vallee, France

[73] Assignee: Compagnie Industrielle des Telecommunications Cit-Alcatel, France

[21] Appl. No.: 800,640

[22] PCT Filed: Mar. 1, 1985

[86] PCT No.: PCT/FR85/00038

§ 371 Date: Nov. 1, 1985

§ 102(e) Date: Nov. 1, 1985

[30] Foreign Application Priority Data

Mar. 2, 1984 [FR] France ..... 84 03322
Dec. 19, 1984 [FR] France ..... 84 19410

[51] Int. Cl.[4] ..... H01J 49/28

[52] U.S. Cl. ..... 250/296; 250/297; 250/281; 313/161

[58] Field of Search ..... 250/296, 294, 281, 282, 250/297, 298; 313/161

[56] References Cited

FOREIGN PATENT DOCUMENTS 1498692 10/1969 Fed. Rep. of Germany ..... 250/281
785908 12/1980 U.S.S.R. ..... 250/281

*Primary Examiner*—Bruce C. Anderson
*Assistant Examiner*—Jack I. Berman
*Attorney, Agent, or Firm*—Sughrue, Mion, Zinn, Macpeak, and Seas

[57] ABSTRACT

A mass spectrograph combining one or more magnetic deflections with the action of electrostatic fields, characterized by the fact that the system is circularly symmetrical; by the fact that the ions are injected radially from a source constituted by a heated circular filament and a pair of small ring-shaped magnets which confine the ionizing electrons to the interior or exterior periphery of the analyzer system per se; by the fact that the first pair of deflection magnets of the analyzer system is ring shaped; and by the fact that the selective action of the other fields, in particular the electrostatic fields, is due to the prior dispersion obtained by the first magnetic induction.

8 Claims, 11 Drawing Figures

MASS SPECTROGRAPH

FIELD OF THE INVENTION

The present invention relates to magnetic deflection mass spectrographs which are more compact and more sensitive than existing devices.

BACKGROUND OF THE INVENTION

Magnetic deflection spectrographs are based on deflecting a narrow beam of ions in a magnetic field. In a given field, the angle of deflection varies by $\sqrt{(1/mV)}$, where V is the accelerating voltage. The deflected beam is received by a narrow slot located at a distance: the deflection angle is thus accurately defined, and for each value of V the slot selects ions having the corresponding mass m, where $mV=C$. The resolution naturally increases with the distance of the selector slot from the deflecting field. The drawbacks of this type of apparatus are obvious: high resolution requires considerable bulk. Further, the use of a narrow beam of ions greatly reduces the sensitivity of the system.

SUMMRY OF THE INVENTION

In the new invention, the separator device is circularly symmetrical: the ions are injected radially in the mid plane of the separator device all around a circular slot: the number of ions injected may thus be very large, and because of the symmetry of the system, these ions are all presented under initial conditions which are identical.

A first magnetic field created by a pair of ring-shaped permanent magnets produces a first separation; ions of different masses describe circular trajectories of different radii and are recovered, under differing initial conditions, by a second field (which may be magnetic or electrostatic) which selectively collects the ions or accentuates their separation prior to collection by a third field. Such a device makes it possible to obtain good resolution and high sensitivity while confining the trajectories to a reduced volume of space.

The ionizing and ion injection device is constituted as follows: a circular heated filament situated in the mid plane of the system emits electrons which are accelerated by a radial electrostatic field; these electrons are thus injected, still in the mid plane, into the magnetic field produced by a pair of ring shaped magnets as in the separator device. The envelope of the circular electron trajectories is a large circle of radius r. Most of the ionizing shocks take place in the immediate vicinity of this circle. A second radial electrostatic field applied beyond the circle r extracts and accelerates the ions formed under the variable voltage V. In this ionizing device, the magnetic field plays three roles; firstly it serves as a barrier to the electrons and prevents them from penetrating into the variable potential region where the ions are accelerated; secondly, a large portion of the electron trajectories is in practice the same as the circle of the envelope, the ions are thus mostly formed in the immediate vicinity of the accelerating field but in a region which is still an equipotential region and they thus have the same initial kinetic energy; and thirdly most of the ions emitted in all directions at speeds corresponding to thermal agitation in a gas are directed towards the acceleration region with the magnetic field acting as an attractive field without modifying the kinetic energy of the ions.

The invention will be better understood with reference to particular embodiments given by way of example and shown in the accompanying drawings, in which:

DESCRIPTION OF PREFERRED EMBODIMENTS

Figure 1:
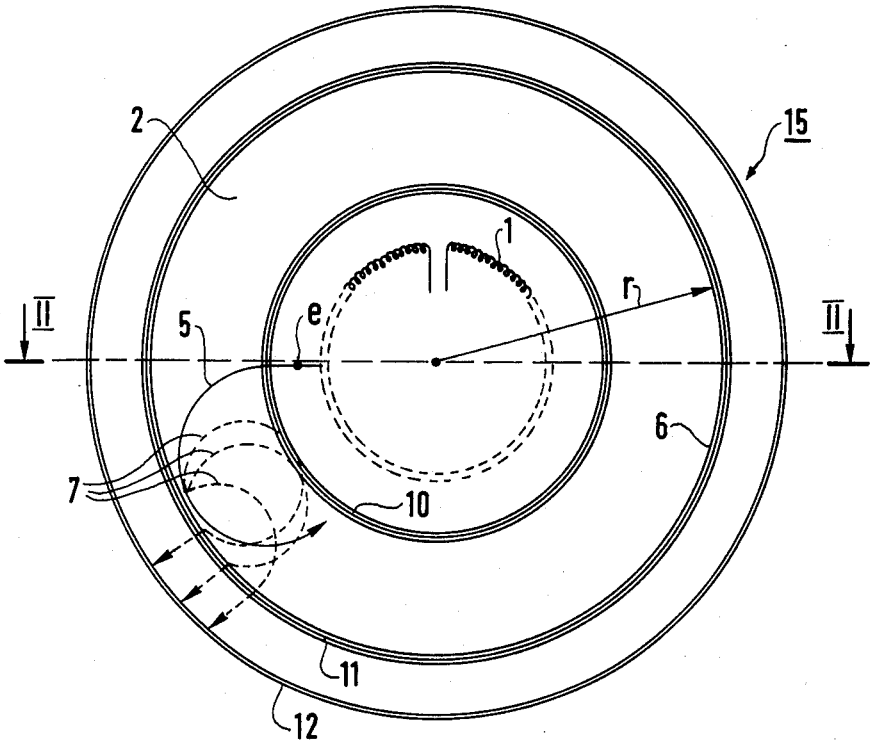
FIG. 1 is a diagrammatic plane view of the ion source of a mass spectrograph in accordance with a first embodiment of the invention.
Figure 2:
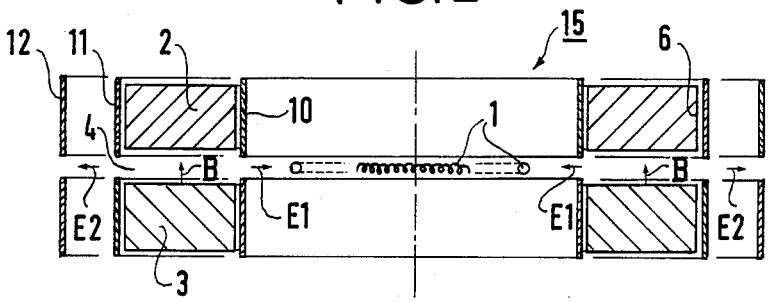
FIG. 2 is a section on line II—II of FIG. 1.

FIGS. 1 and 2 are diagrams showing one embodiment of an ion source 15. Electrons e emitted by a heated filament 1 are accelerated by an electric field E1 produced by a split cylindrical electrode 10. They penetrate into a magnetic induction field B produced by ring-shaped magnets 2 and 3. In the air gap 4 they describe circular trajectories such as 5 having the outside circumference 6 of the magnets as their envelope. The ions formed in the vicinity of this circumference are directed by the induction B (dashed line trajectories 7) towards an accelerating electric field E2 produced between two split cylindrical electrodes 11 and 12 which then injects the ions into the analyzer system (not shown).

Figure 3:
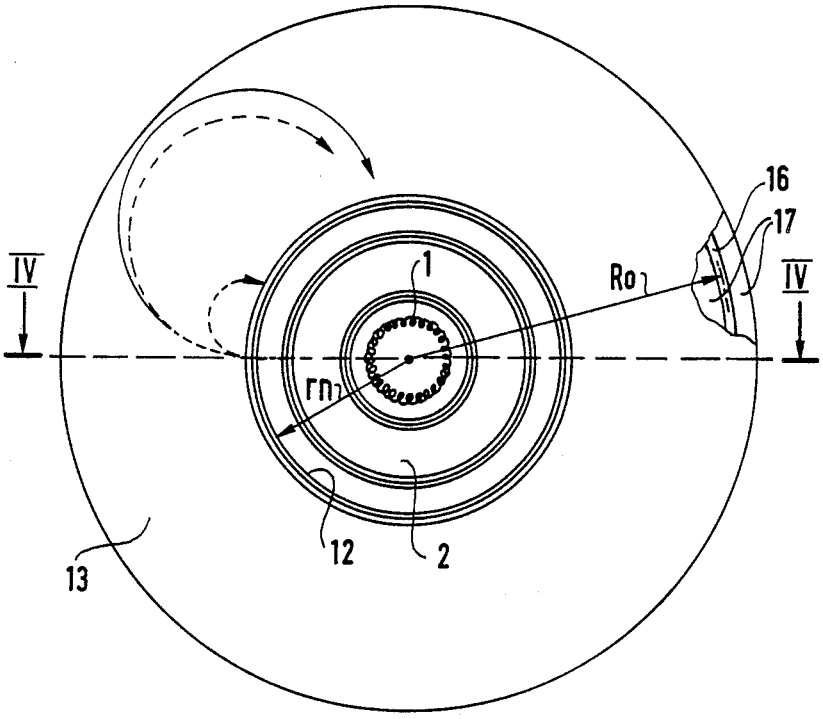
FIG. 3 is a diagrammatic view from above of the analysis system of a mass spectrograph mentioned with reference to FIGS. 1 and 2.
Figure 4:
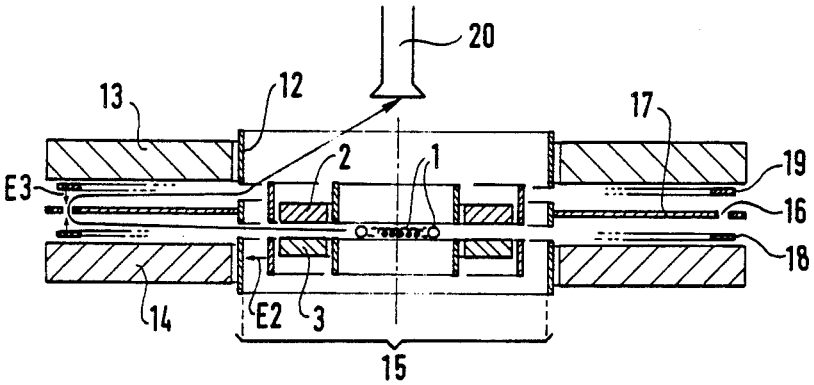
FIG. 4 is a section on line IV—IV of FIG. 3.

FIGS. 3 and 4 show a simplified embodiment of the analyzer system. The above-described ion source 15 is in the center of the system. The ions are injected radially into the gap between two ring-shaped magnets 13 and 14 at a kinetic energy corresponding to the accelerating potential V. They describe circular trajectories of radius $r=(1/B)\sqrt{(2mV/e)}$. For a given value V, all the trajectories corresponding to the same mass have an envelope in the form of a large circle of radius:

$$R=\sqrt{r_m^2+\frac{2mV}{e}\cdot\frac{1}{B^2}}+\frac{1}{B}\sqrt{\frac{2mV}{c}}$$

The ions are selected by a circular slot 16 of radius Ro provided in a screen 17 disposed between the magnets 13 and 14. The slot 16 is disposed between two reflector electrodes 18 and 19 which produce a field E3. For $R \simeq Ro$, the ions pass through the slot and continue their circular trajectory towards the axis of the system and are captured by a mutiplier 20. (Each mass corresponds to a value of V such that $R=Ro$. By varying V, it is possible to successively select all masses).

Figure 5:
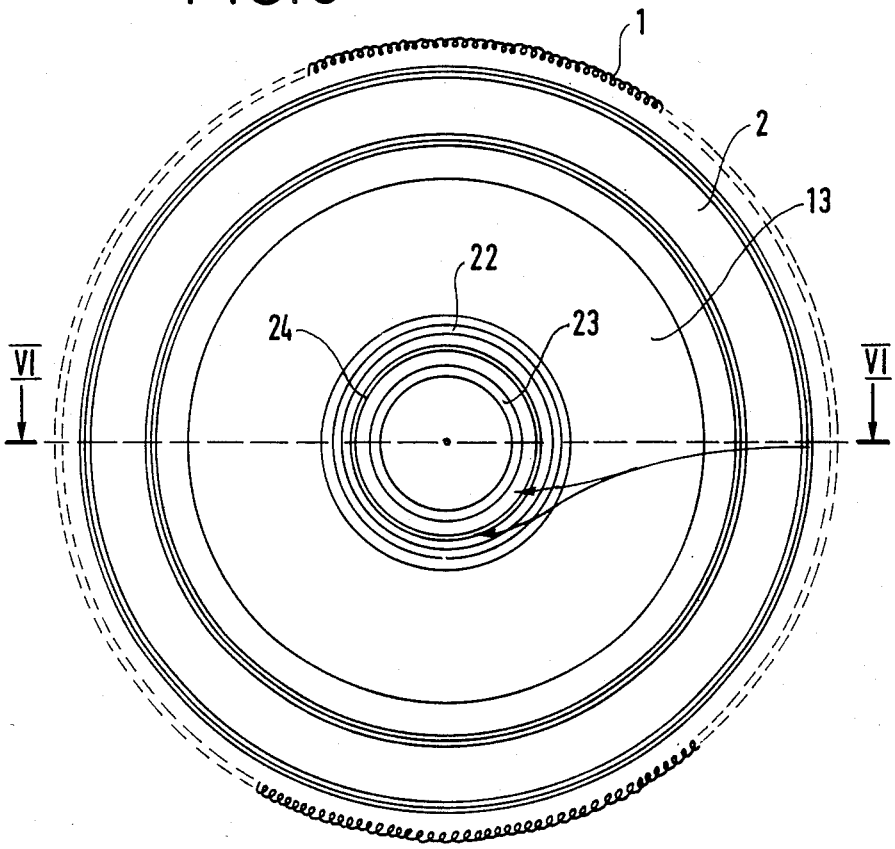
FIG. 5 is a diagrammatic view from above of a variant mass spectrograph.
Figure 6:
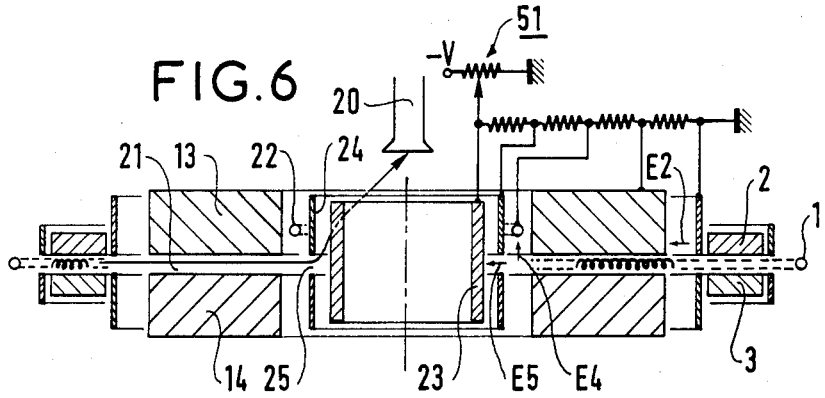
FIG. 6 is a section view on line VI—VI of FIG. 5.

FIGS. 5 and 6 show an inverse embodiment: the source of ions is of the same type as in the preceding example but it is located around the analyzer system in this case. The same references designate the same items, but in this case the filament 1 is outside the magnets 2 and 3 and these are disposed around the magnets 13 and 14. The ions describe circular arcs in the magnet gap 21 of radius:

$$R = \frac{1}{B}\sqrt{\frac{2\,mV}{c}}$$

At the output from the gap 21 they receive a small axial speed component by virtue of a field E4 produced by an annular electrode 22. This action is selective and is more marked for ions which pass this electrode at a small angle. The ions are then distributed by a radial electric field E5 produced between cylindrical electrodes 23 and 24, with the electrode 24 including a slot 15. Ions which have a quasi-circular trajectory between the cylinders ($mv^2/r=eE(r)$) may leave the analysis space without encountering the inside cylinder 23 and are collected by the multiplier 20. In FIG. 6, the potentials of the various electrodes are illustrated by a potential divider 51.

Figure 7:
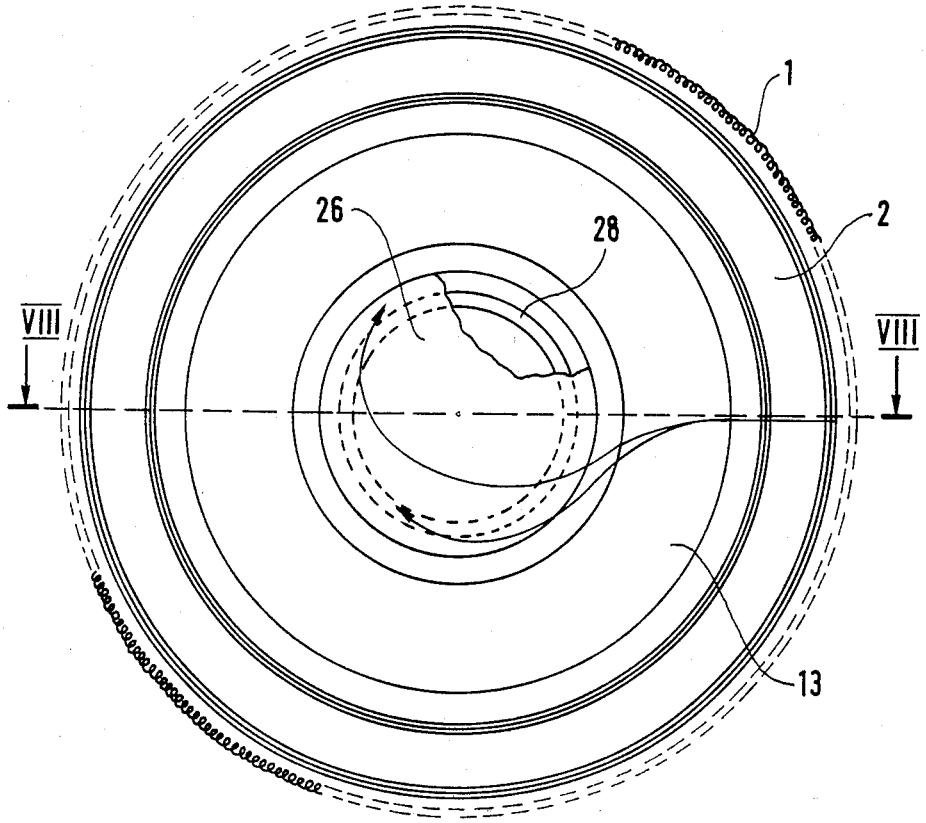
FIG. 7 is a view from above of a variant embodiment of a mass spectrograph.
Figure 8:
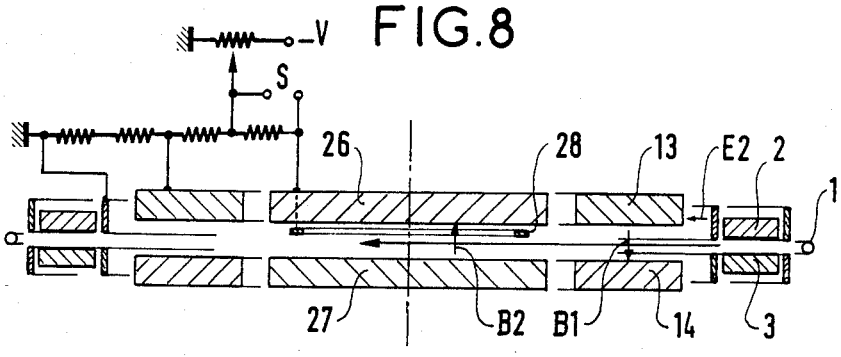
FIG. 8 is a section view on line VIII—VIII of FIG. 7.

FIGS. 7 and 8 show an inverse embodiment like the preceding embodiment, but in which the radial electric field E5 of the previous example is replaced by a second magnetic induction B2 produced by magnets 26 and 27 situated at the center of the ring magnets 13 and 14. The magnetic field B2 is in the opposite direction to the field B1 produced by the magnets 13 and 14. The trajectories have the shape shown in FIG. 7. An annular electrode 28 raised to a potential which is slightly less than that in the space filled with the field B2 collects only those ions whose trajectory is at least partially parallel with the electrode 28. It will be observed that in this case (two oppositely directed magnetic fields) a magnetic circuit can be provided which is closed by external yokes.

In all the systems described, the resolution can be further improved by causing the magnetic induction to increase or decrease with distance from the axis (by using conical gaps).

To clarify ideas on the dimensions of the device, it may be noted that the overall diameter is approximately equal to three or four times the radius r of the ion trajectories. For $B=2.10^{-2}Wb/m^2$, (a value which is easily obtained), and for V varying from 1600 to 16 V, and for the mass number from 100 to 1, ($mV/e=C$), it turns out that $r=1.10^{-2}m$. The outside diameter of the apparatus is thus about ten centimeters.

Such apparatus is essentially intended for qualitative and quantitative analysis of gas mixtures at low pressure, a problem which is fundamental to manufacturing numerous electronic components in vacuo. In prior devices, a very long ion source injects a sheet of ions parallel to the surface of the pole parts of a magnetic circuit, said sheet substantially occupying the mid plane of the system. All ions having the same mass number describe circular orbits of equal radius. The set of these orbits give a common tangential envelope along which ion density is at a maximum and where they are collected under identical conditions.

Compared with existing magnetic spectrometers, systems in accordance with the invention have two essential advantages:

(1) The sensitivity of a spectrograph is the product of the source ion density and the useful volume of the source. This volume is proportional to the length of the ion extraction slot.

In the present invention the slot is parallel (and not perpendicular) to the plane of the pole parts. It is thus very long (like the ion source) without increasing the gap in the magnetic circuit. The sensitivity can thus be much greater.

(2) All the ion trajectories are in the mid plane of the gap and the gap can therefore be of reduced size. The bulk of the magnetic circuit is thus greatly reduced.

It may be observed that in conventional devices the extraction slot is perpendicular to the plane of the pole parts. Its length and the useful volume of the ion source cannot be increased, even slightly, without giving rise to an excessively large magnetic circuit.

The systems described above are of circular symmetry.

Figure 9:
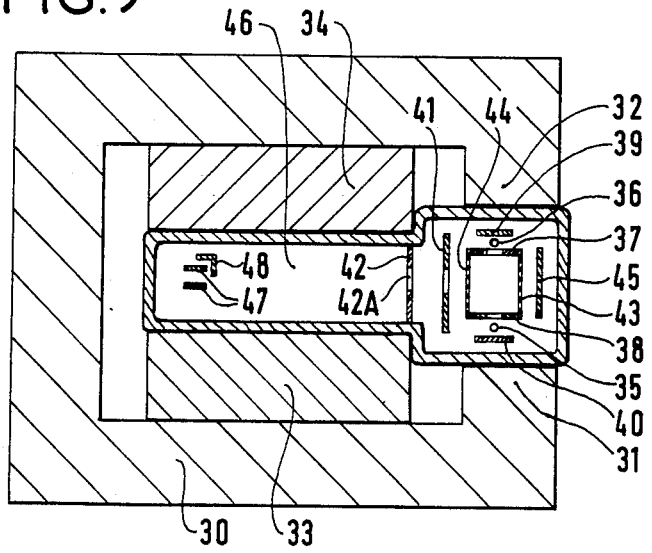
FIG. 9 is a diagrammatic view of a variant embodiment of a spectrograph.
Figure 10:
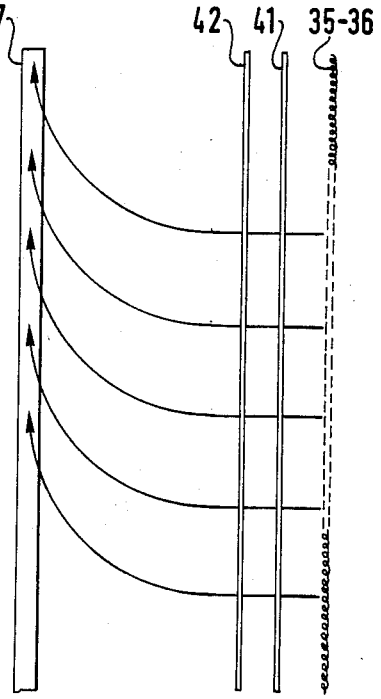
FIG. 10 is an elevation section of the FIG. 9 device.

The magnetic circuits are ring shaped. The variant embodiment now described completes the definition of the source, and of the collector, and develops a particular case which corresponds to selecting an infinite value for the radius of the ring. The geometry is then rectilinear and the implementation of the magnetic circuit is greatly simplified. Reference is made to FIG. 9 which is a cross section through the device. It comprises a soft iron magnetic circuit 30 whose section, as can be seen in FIG. 9, is C-shaped and which defines a gap between two facing pole faces 31 and 32, which gap is in the form of a very elongate rectangular parallelipiped. Magnets 33 and 34 produce the magnetic field. Two filaments, 35 and 36 are placed in the gap and parallel thereto. An extraction slot 42A is likewise parallel to the filaments.

The source is immersed in a weak magnetic field obtained by a shunt from the main magnetic circuit. The electrons emitted by the filaments 35 and 36 are accelerated by a potential of about 100 Volts between the filaments and the slotted electrodes 37 and 38. They describe helical trajectories in the ionization chamber and they are reflected by two auxiliary electrodes 39 and 40 which are at a potential which is slightly negative: the trajectories can thus be very long.

A variable potential V for extracting and accelerating ions is established between electrodes 41 and 42. This potential could penetrate far enough into the ionization chamber to extract the ions. However, the ions would then not be formed in a region which was strictly equipotential, and this would lead to a degree of dispersion in their initial speeds. This effect may be eliminated and resolution may be improved by adding two grids 43 and 44 and a repulsion electrode 45 which is raised to a positive potential.

After being injected into the magnetic circuit gap 46, ions of the same mass number n describe circular trajectories in the mid plane having the same radius R:

$$R = \frac{1}{B}\sqrt{\frac{2\,nV}{(e/m)}}$$

(where e=proton charge; m=proton mass; B=induction).

For a suitable value of V, all the trajectories corresponding to ions of the same mass number have their common tangent level with the rectilinear deflection electrodes 47. The corresponding ions are captured by a Faraday cage 48. By varying V, ions of different masses can be successively captured.

To keep the value of V in a reasonable range, a system may be used having two ion sources and two collectors. The first collector (closer to the source) serves to select masses in the range 10 to 1, and the second serves to collect masses in the range 100 to 10 for a given scan voltage V in the range 100 to 100 Volts.

Figure 11:
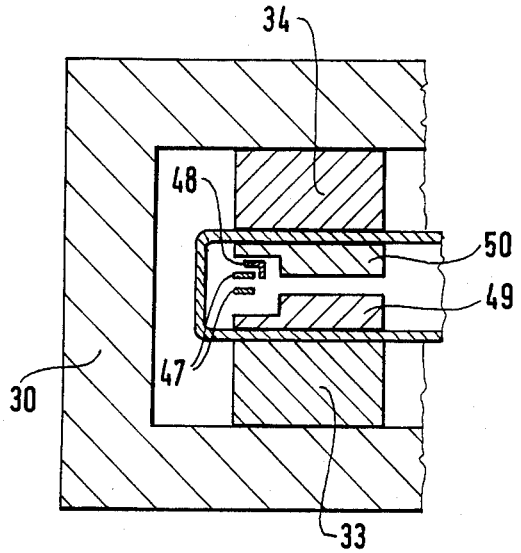
FIG. 11 is a plan view of a portion of a variant.

Finally, the profile of the pole parts 49 and 50 may be modified as shown diagrammatically in FIG. 11. The radius of curvature of the trajectories is thus greatly increased at the collector, thereby improving resolution without greatly increasing bulk.

Relative to existing mass spectrographs, such a system has greatly increased sensitivity and much reduced bulk.

It is thus naturally intended for applications where high sensitivity is required with minimum bulk. (Gas analysis in ultra-high vacuum systems, helium detection, monitoring gases in industrial processes, etc.).

What is claimed is:

1. A mass spectrograph combining one or more magnetic deflections with the action of electrostatic fields, said mass spectrograph comprising a circularly symmetrical analyzer system including a heated circular filament forming a source of ions, a pair of small ring-shaped magnets for injecting ions radially from said source, and which confine the ionizing electrons to the interior periphery or to the exterior periphery of the analyzer system; a first pair of deflection magnets of ring shape forming a first magnetic induction field; and means for effecting selective action of other electrostatic fields due to prior dispersion obtained by the first magnetic induction field.

2. A mass spectrograph according to claim 1, wherein the source of ions is at the center of the system in empty space inside the ring shaped deflection magnets; a radial electrostatic field directed away from the axis of the system is applied between first and second coaxial cylinders housed in the space left free by the ring shaped magnets; a disk pierced by a narrow circular slot is situated in the mid plane between the ring shaped magnets; two annular electrodes of the same radius as the slot are placed respectively on either side of the disk and are subjected to a potential which is slightly greater than that of the disk; and a multiplier lies at the center of the system such that for each value of the acceleration potential applied to the cylinders, ions having a mass such that their trajectories are tangential to a circle having the same radius as the slot pass therethrough and return towards the central portion of the analyzer system where they are captured by said multiplier.

3. A mass spectrograph according to claim 1, wherein the source of ions is at the outer periphery of the analyzer system; the radial electrostatic field directed towards the axis of the system is applied between first and second coaxial cylinders housed in the space left free by the ring shaped magnets; a polarized annular electrode is situated between the ring shaped deflection magnets and the first cylinder and applies an axial speed component to the ions; and a multiplier is positioned at the center of the system such that for each value of the accelerating potential applied to the cylinders, ions of suitable mass describe quasi-helical trajectories between the cylinders and are captured by said multiplier situated on the axis of the system, while ions of other masses are lost on the inner cylinder.

4. A mass spectrograph according to claim 1, wherein the source of ions is at the outer periphery of the system; a second pair of deflection magnets of cylindrical section is lodged in the empty space left by the first pair of ring shaped deflection magnets and produces induction in the opposite direction to the first pair; a polarized annular collection electrode is situated on one of the internal faces of the central magnet, and an external yoke and the magnets together constitute a closed magnetic circuit.

5. A mass spectrograph according to claim 1, wherein a conical gap is employed such that the magnetic inductions are made to increase or decrease with distance from the axis.

6. A mass spectrograph combining the action of magnetic and electrostatic fields, said mass spectrograph comprising: a magnetic circuit, heated filaments defining an ion source and means forming an ion extraction slot extending parallel to the surface of pole parts of the magnetic circuit forming a gap therebetween and being of substantially the same length as said pole parts; said source of ions being also immersed in a magnetic field created by shunt from the main circuit, thereby increasing the ionizing effectiveness of electrons emitted from the heated filaments; means responsive to a variable acceleration voltage for injecting the ions into the selection magnetic field and the ion trajectories are substantially contained in the mid plane of the gap; and for a given acceleration voltage and a given mass number, all the trajectories have a common tangent which, for a specific value of the acceleration voltage is level with a rectilinear deflection electrode which sends the ions to at least one collector.

7. A mass spectrograph according to claim 6, wherein the width of the gap is greater in the vicinity of the collector, thereby increasing the radius of curvature of the ion trajectories at that point and increasing the resolution without substantially increasing the dimensions of the system.

8. A mass spectrograph according to claim 6, wherein said at least one collector comprises at least two collectors placed at suitable distances from the source for collecting ions having mass numbers in the ranges of 1 to n, n to $n^2$, etc., respectively for a given scanning range of the accelerating voltage.

* * * * *